US011372355B2

(12) United States Patent
Watanabe

(10) Patent No.: US 11,372,355 B2
(45) Date of Patent: Jun. 28, 2022

(54) FIXING DEVICE HAVING THERMAL EQUALIZER AND IMAGE FORMING APPARATUS INCORPORATING SAME

(71) Applicant: Natsuki Watanabe, Kanagawa (JP)

(72) Inventor: Natsuki Watanabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/392,277

(22) Filed: Aug. 3, 2021

(65) Prior Publication Data

US 2022/0066366 A1 Mar. 3, 2022

(30) Foreign Application Priority Data

Aug. 25, 2020 (JP) ..... JP2020-141746

(51) Int. Cl.
*G03G 15/20* (2006.01)

(52) U.S. Cl.
CPC ..... *G03G 15/2053* (2013.01); *G03G 15/2017* (2013.01); *G03G 2215/2035* (2013.01)

(58) Field of Classification Search
CPC ..... G03G 15/2017; G03G 15/2053; G03G 15/2046; G03G 2215/2035
USPC ..... 399/329; 219/216
See application file for complete search history.

(56) References Cited

U.S. PATENT DOCUMENTS

2011/0182638 A1* 7/2011 Ishii ..... G03G 15/2053 399/333
2014/0199100 A1* 7/2014 Seol ..... G03G 15/2064 399/329
2015/0055994 A1* 2/2015 Shoji ..... G03G 15/2053 399/329
2015/0346662 A1* 12/2015 Kawarasaki ..... G03G 15/2053 399/329
2016/0274514 A1* 9/2016 Ishii ..... G03G 15/2053
2017/0176907 A1 6/2017 Sawada et al.
2018/0017910 A1 1/2018 Sawada et al.
2019/0377286 A1 12/2019 Naitoh et al.
2020/0033764 A1 1/2020 Kajiyama et al.
(Continued)

FOREIGN PATENT DOCUMENTS

JP 2017-116921 6/2017
JP 2018-010258 1/2018
(Continued)

*Primary Examiner* — Robert B Beatty
(74) *Attorney, Agent, or Firm* — Xsensus LLP

(57) ABSTRACT

A fixing device includes a fixing rotator, a pressure rotator, a belt holder, a pressure gear, a thermal equalizer, a nip formation pad, and a support. The thermal equalizer includes a first face facing a fixing nip between the fixing rotator and the pressure rotator, and second and third faces bending and extending from upstream end and downstream end, respectively, of the first face in a direction of rotation of the fixing rotator. An upstream boundary portion between the first face and the second face and a downstream boundary portion between the first face and the third face each include, at least in a longitudinal end portion of the thermal equalizer proximate to the pressure gear, an inclined portion inclined to narrow the first face toward a longitudinal end of the thermal equalizer and having an angle of inclination not greater than 3°.

10 Claims, 7 Drawing Sheets

(56) References Cited

U.S. PATENT DOCUMENTS

| | | | |
|---|---|---|---|
| 2021/0041820 | A1 | 2/2021 | Fujiwara |
| 2021/0165349 | A1 | 6/2021 | Watanabe |

FOREIGN PATENT DOCUMENTS

| | | |
|---|---|---|
| JP | 2020-003639 | 1/2020 |
| JP | 2021-026153 | 2/2021 |

* cited by examiner

FIXING DEVICE HAVING THERMAL EQUALIZER AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2020-141746, filed on Aug. 25, 2020, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image onto a recording medium and an image forming apparatus for forming an image on a recording medium with the fixing device.

Related Art

Typical image forming apparatuses such as copiers, printers, or facsimile machines form an image in an image forming process such as electrophotographic recording, electrostatic recording, or magnetic recording. Such image forming apparatuses form directly, or indirectly by image transferring, form the image (i.e., unfixed toner image) on a recording medium such as a recording sheet, printing paper, sensitized paper, or dielectric-coated paper. Note that such a recording medium may be referred to simply as a sheet in the following description. As a fixing device for fixing the unfixed toner image, for example, a belt type fixing device or a surf-fixing (or film-fixing) device including a ceramic heater are known.

SUMMARY

In one embodiment of the present disclosure, a novel fixing device includes a fixing rotator, a pressure rotator, a belt holder, a pressure gear, a thermal equalizer, a nip formation pad, and a support. The pressure rotator presses an outer circumferential surface of the fixing rotator. The belt holder holds the fixing rotator. The pressure gear is disposed proximate to a longitudinal end of the pressure rotator to rotate the pressure rotator. The thermal equalizer is disposed facing an inner circumferential surface of the fixing rotator along a longitudinal direction of the pressure rotator. The nip formation pad presses the inner circumferential surface of the fixing rotator via the thermal equalizer to form a fixing nip between the fixing rotator and the pressure rotator. The support supports the thermal equalizer and the nip formation pad. The thermal equalizer includes a first face, a second face, and a third face. The first face faces the fixing nip. The second face bends and extends from an upstream end of the first face in a direction of rotation of the fixing rotator. The third face bends and extends from a downstream end of the first face in the direction of rotation of the fixing rotator. Each of an upstream boundary portion as a boundary between the first face and the second face and a downstream boundary portion as a boundary between the first face and the third face includes, at least in a longitudinal end portion of the thermal equalizer proximate to the pressure gear, an inclined portion inclined to narrow the first face toward a longitudinal end of the thermal equalizer and having an angle of inclination not greater than 3°.

Also described is a novel image forming apparatus incorporating the fixing device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
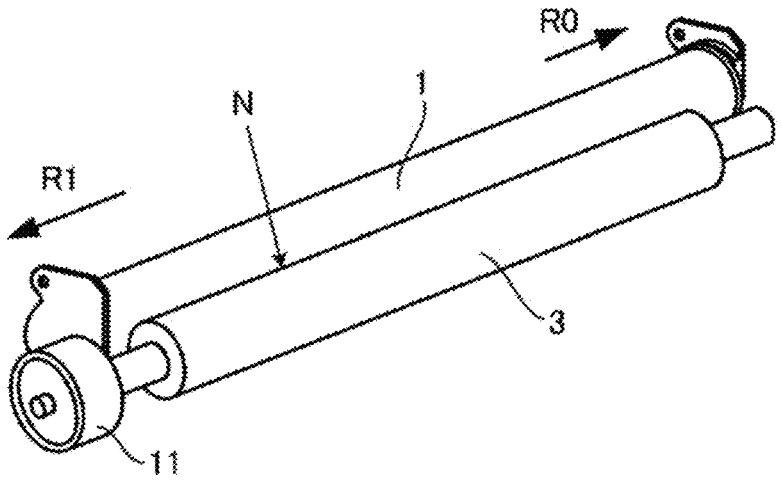
FIG. 1 is a perspective view of a configuration of a fixing device according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result. As used herein, the singular forms "a," "an," and "the" are intended to include the plural forms as well, unless the context clearly indicates otherwise.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

It is to be noted that, in the following description, suffixes Y, M, C, and Bk denote colors of yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

Figure 2:
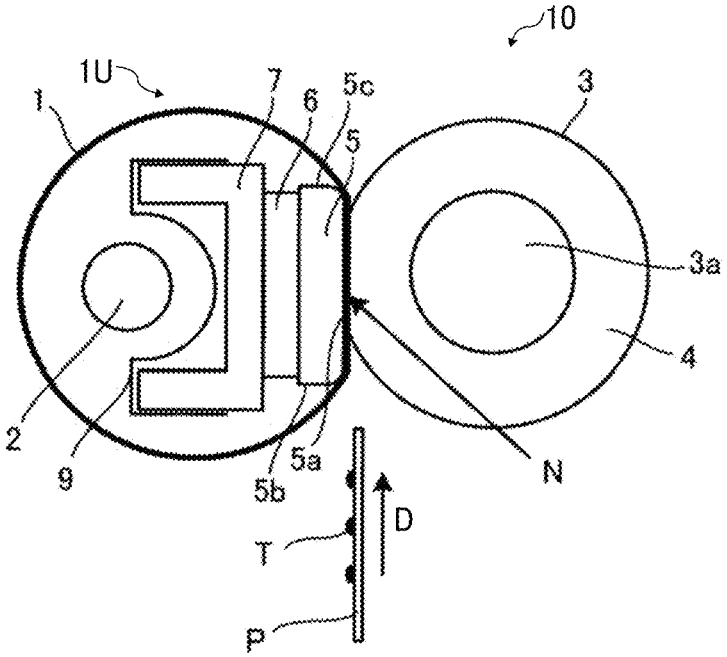
FIG. 2 is a cross-sectional view of a configuration of a fixing device according to an embodiment of the present disclosure.

Initially with reference to FIGS. 1 to 2, a description is given of a fixing device according to an embodiment of the present disclosure.

FIG. 1 is a perspective view of a configuration of a fixing device 10 according to an embodiment of the present disclosure. FIG. 2 is a cross-sectional view of the configuration of the fixing device 10.

The fixing device 10 illustrated in FIGS. 1 and 2 is a fixing device that conveys a sheet or recording medium P bearing an unfixed toner image T and fixes the unfixed toner image T onto the recording medium P. The fixing device 10 includes a fixing belt 1 serving as a fixing rotator, a pressure roller 3 serving as a pressure rotator, a belt holder 8, a pressure gear 11, a thermal equalizer 5, a nip formation pad 6, and a support 7. Specifically, the fixing belt 1 is a rotatable endless belt. The pressure roller 3 is rotatable and presses an outer circumferential surface of the fixing belt 1. The belt holder 8 holds the fixing belt 1. The pressure gear 11 is disposed proximate to a longitudinal end of the pressure roller 3 to rotate the pressure roller 3. In other words, the pressure gear 11 is disposed at a longitudinal end part of the pressure roller 3. The thermal equalizer 5 is disposed facing an inner circumferential surface of the fixing belt 1 along a longitudinal direction (i.e., axial direction) of the pressure roller 3. The nip formation pad 6 presses the inner circumferential surface of the fixing belt 1 via the thermal equalizer 5 to form an area of contact, herein referred to as a fixing nip N, between the fixing belt 1 and the pressure roller 3. The support 7 supports the thermal equalizer 5 and the nip formation pad 6.

In FIG. 1, directions indicated by arrows R1 and R0 indicate a drive part and a non-drive part, respectively. The drive part and the non-drive part may be referred to as a drive part R1 and a non-drive part R0, respectively, in the following description. For example, FIG. 1 illustrates the longitudinal end part (as a first longitudinal end part) of the pressure roller 3 provided with the pressure gear 11 as the drive part R1. On the other hand, FIG. 1 illustrates the other longitudinal end part (as a second longitudinal end part) of the pressure roller 3 as the non-drive part R0.

As illustrated in FIG. 2, the fixing device 10 further includes a heater 2 and a reflector 9. The fixing belt 1 and the components disposed inside a loop formed by the fixing belt 1 construct a belt unit 1U, which is detachably coupled to the pressure roller 3. The heater 2 is disposed inside the loop formed by the fixing belt 1 to heat the fixing belt 1. The heater 2 is, e.g., a halogen heater, an induction heater (IH), a resistive heat generator, or a carbon heater.

The thermal equalizer 5 and the nip formation pad 6 extend in a longitudinal or lengthwise direction (i.e., axial direction) of the fixing belt 1, thus contributing to the formation of the fixing nip N.

The thermal equalizer 5 prevents heat generated by the heater 2 from being stored locally and facilitates conduction of heat in a longitudinal direction of the thermal equalizer 5. Thus, the thermal equalizer 5 reduces the unevenness in temperature of the fixing belt 1 in the axial direction of the fixing belt 1.

In the present embodiment, the thermal equalizer 5 includes a surface facing the pressure roller 3 that directly contacts the fixing belt 1 and therefore serves as a nip formation surface.

The thermal equalizer 5 engages the nip formation pad 6 such that the thermal equalizer 5 covers a belt-facing surface of the nip formation pad 6 facing the inner circumferential surface of the fixing belt 1. Thus, the thermal equalizer 5 is coupled to the nip formation pad 6. For example, the thermal equalizer 5 engages the nip formation pad 6 with, e.g., a claw. Alternatively, the thermal equalizer 5 may be attached to the nip formation pad 6 with, e.g., an adhesive. A positioner is preferably provided to position the thermal equalizer 5 and the nip formation pad 6 relative to each other.

The thermal equalizer 5 includes a first face 5*a*, a second face 5*b*, and a third face 5*c*. The first face 5*a* faces the fixing nip N. The second face 5*b* bends and extends from an upstream end of the first face 5*a* in a direction of rotation of the fixing belt 1. The third face 5*c* bends and extends from a downstream end of the first face 5*a* in a direction of rotation of the fixing belt 1.

An upstream boundary portion 51 is a boundary between the first face 5*a* and the second face 5*b*; whereas a downstream boundary portion 52 is a boundary between the first face 5*a* and the third face 5*c*. Preferably, the upstream boundary portion 51 and the downstream boundary portion 52 are smoothly continuous curved surfaces without edges.

In a plan view of the nip formation surface of the thermal equalizer 5, the upstream boundary portion 51 corresponds to the upstream end of the first face 5*a* in the direction of rotation of the fixing belt 1; whereas the downstream boundary portion 52 corresponds to the downstream end of the first face 5*a* in the direction of rotation of the fixing belt 1.

Although FIG. 2 illustrates the fixing nip N in a flat shape, the fixing nip N may be contoured into a recess or other shapes. One advantage of the fixing nip N defining the recess in the fixing belt 1 is that the recessed fixing nip N facilitates separation of the sheet P (i.e., recording medium) from the fixing belt 1 and reducing paper jam, because the recessed fixing nip N directs a leading end of the sheet P toward the pressure roller 3 when the sheet P is ejected from the fixing nip N.

The fixing belt 1 is an endless belt or film made of a metal material, such as nickel or stainless steel (e.g., steel use stainless or SUS), or a resin material such as polyimide. The fixing belt 1 is constructed of a base layer and a release layer. The release layer, as an outer surface layer of the fixing belt 1, is made of, e.g., perfluoroalkoxy alkane (PFA) or polytetrafluoroethylene (PTFE) to facilitate separation of toner contained in the toner image T on the sheet P from the fixing belt 1. Optionally, an elastic layer made of, e.g., silicone rubber may be interposed between the base layer and the release layer made of, e.g., PFA or PTFE of the fixing belt 1. In a case in which the fixing belt 1 incorporates no elastic layer made of, e.g., silicone rubber, the fixing belt 1 has a decreased thermal capacity that enhances the fixing property of being heated quickly to a desired fixing temperature at which the toner image T is fixed onto the sheet P. However, as the pressure roller 3 and the fixing belt 1 sandwich and press the unfixed toner image T onto the sheet P, slight surface asperities in the fixing belt 1 may be transferred onto the toner image T on the sheet P, resulting in variation in gloss of the solid toner image T that may appear as an orange peel image on the sheet P. The elastic layer is preferably provided to address such a situation, provided that the elastic layer made of, e.g., silicone rubber has a thickness not smaller than 100 μm. As the elastic layer made of, e.g., silicone rubber deforms, the elastic layer absorbs the slight surface asperities in the fixing belt 1, thereby preventing formation of the faulty orange peel image.

The support 7 such as a stay is disposed inside the loop formed by the fixing belt 1 to support the nip formation pad 6. As the thermal equalizer 5 and the nip formation pad 6 receive pressure from the pressure roller 3, the support 7 prevents the thermal equalizer 5 and the nip formation pad 6 from being bent by such pressure. Accordingly, the fixing nip N is formed retaining an even width in the axial direction of the fixing belt 1. In other words, the fixing nip N retains an even length in a direction indicated by arrow D in FIG. 1 throughout an entire width of the fixing belt 1 in the axial direction of the fixing belt 1. Note that the direction indicated by arrow D is a direction in which the sheet P is conveyed. The direction indicated by arrow D may be referred to as a sheet conveyance direction D in the following direction. The support 7 is mounted on and secured to the belt holder 8 such as a flange at each longitudinal end portion of the support 7, thus being positioned inside the fixing device 10. Note that a longitudinal direction of the support 7 is parallel to the axial direction of the fixing belt 1.

The reflector 9 is interposed between the heater 2 and the support 7, to reflect the radiation heat from the heater 2 toward the inner circumferential surface of the fixing belt 1. Thus, the reflector 9 prevents the support 7 from being heated by the heater 2 and reduces waste of energy. In a case in which the fixing device 10 excludes the reflector 9, a surface of the support 7 facing the heater 2 may be insulated or given a mirror finish to reflect the radiation heat from the heater 2 toward the inner circumferential surface of the fixing belt 1.

The pressure roller 3 includes a core 3*a* and an elastic layer 4 resting on the core 3*a*. Preferably, a surface release layer, made of PFA or PTFE, rests on the elastic layer 4 to facilitate separation of the sheet P from the pressure roller 3.

The pressure gear 11 is disposed at the first longitudinal end part (i.e., the drive part R1) of the pressure roller 3. A driver such as a motor is situated inside an image forming apparatus that includes the fixing device 10. A driving force generated by the driver is transmitted to the pressure roller 3 through a gear train including the pressure gear 11, thereby rotating the pressure roller 3.

A detailed description of the driving of the pressure roller 3 is deferred.

A spring, for example, presses the pressure roller 3 against the nip formation pad 6 via the fixing belt 1. As the spring presses and deforms the elastic layer 4 of the pressure roller 3, the pressure roller 3 forms the fixing nip N having a given width, which is a given length in the sheet conveyance direction D.

The pressure roller 3 may be a hollow roller or a solid roller. In a case in which the pressure roller 3 is a hollow roller, a heater such as a halogen heater may be disposed inside the hollow roller. The elastic layer 4 may be made of solid rubber. Alternatively, in a case in which no heater is situated inside the pressure roller 3, the elastic layer 4 may be made of sponge rubber. The sponge rubber is preferable to the solid rubber because the sponge rubber has enhanced thermal insulation that draws less heat from the fixing belt 1.

As the driver drives and rotates the pressure roller 3, a driving force of the driver is transmitted from the pressure roller 3 to the fixing belt 1 at the fixing nip N, thereby rotating the fixing belt 1 by friction between the fixing belt 1 and the pressure roller 3.

At the fixing nip N, the fixing belt 1 rotates while being sandwiched by the pressure roller 3 and the nip formation pad 6; whereas, at a circumferential span of the fixing belt 1 other than the fixing nip N, the fixing belt 1 rotates while each axial end portion of the fixing belt 1 is guided by the belt holder 8 (e.g., flange).

With the configuration described above, the fixing device 10 attaining quick warm-up is manufactured at reduced costs.

Figure 3A:
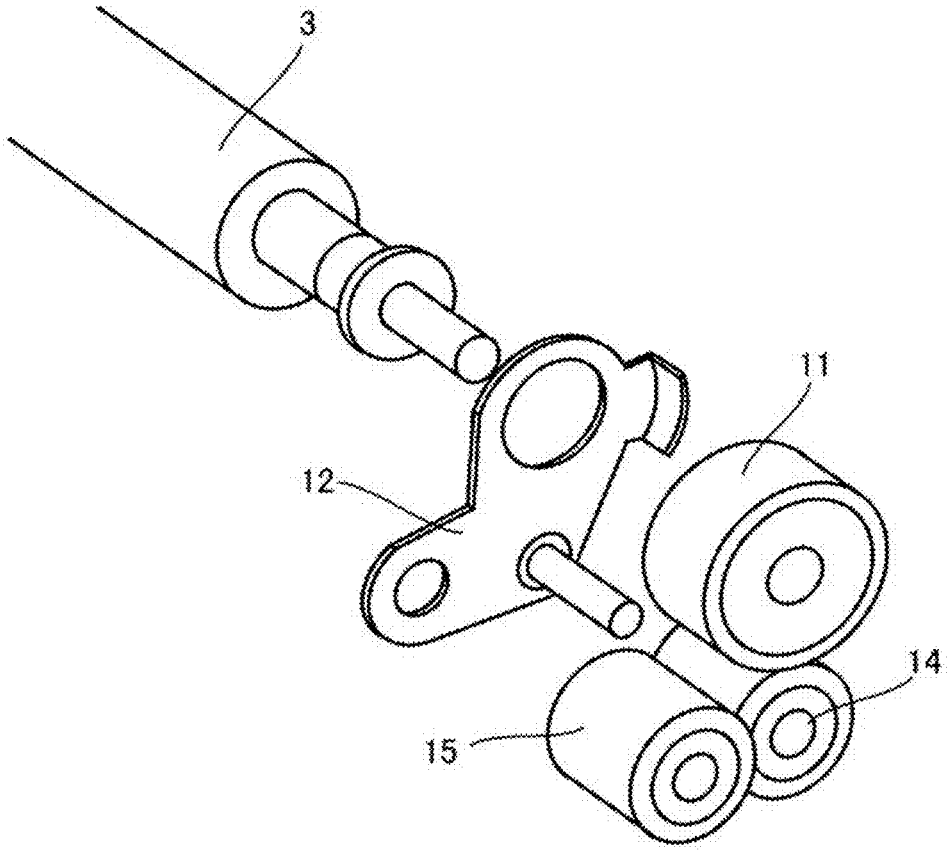
FIG. 3A is a perspective view of a configuration of a drive assembly of a fixing device according to an embodiment of the present disclosure.
Figure 3B:
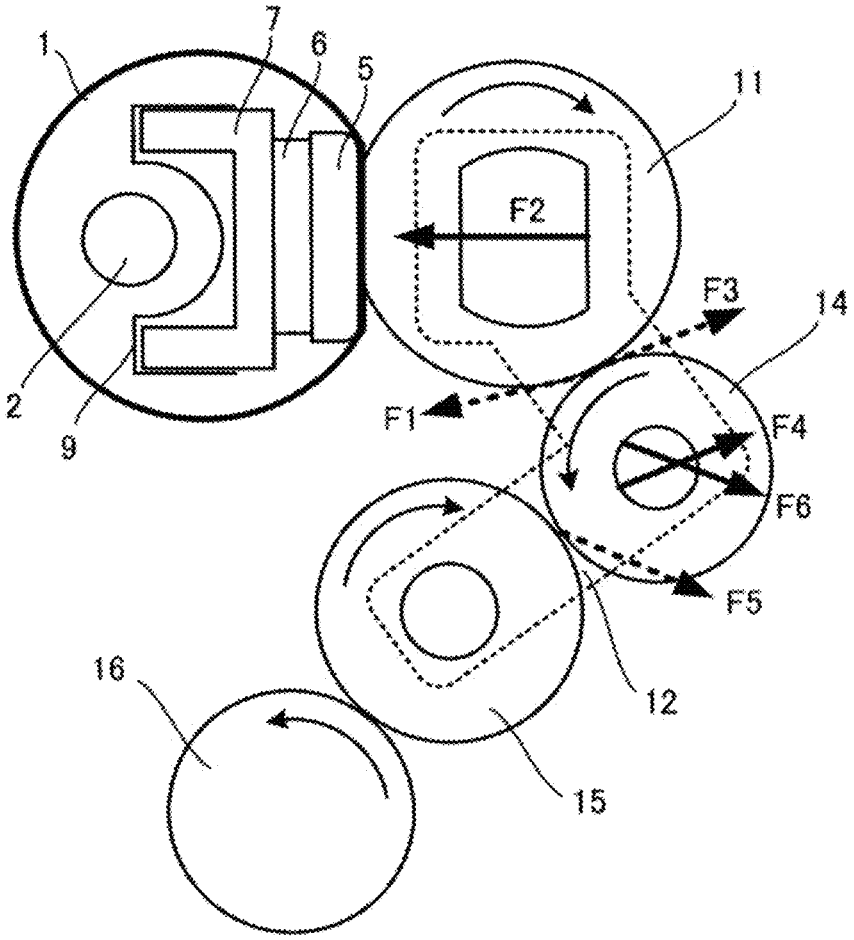
FIG. 3B is a cross-sectional view of the configuration of the drive assembly of FIG. 3A.

FIGS. 3A and 3B illustrate a configuration of a drive assembly on the drive part R1 of the pressure roller 3 illustrated in FIG. 1. Specifically, FIG. 3A is a perspective view of the drive assembly at the drive part R1 of the pressure roller 3. FIG. 3B is a cross-sectional view of the drive assembly of the pressure roller 3.

As illustrated in FIGS. 3A and 3B, the drive assembly of the pressure roller 3 in the present embodiment includes a motor 16, an idler gear pair (constructed of a first idler gear 14 and a second idler gear 15), the pressure gear 11, and a pressure bracket 12. The idler gear pair transmits the driving force from the motor 16.

The pressure gear 11 is a spur gear or a helical gear disposed on a rotary shaft of the pressure roller 3 to rotate together with the pressure roller 3.

The first idler gear 14 meshes with the pressure gear 11. A shaft 12*a* that is provided for the pressure bracket 12 rotatably holds the first idler gear 14 as the shaft 12*a* is inserted through the center of rotation of the first idler gear 14.

The second idler gear 15 that meshes with the first idler gear 14 and the first idler gear 14 that meshes with the pressure gear 11 construct a gear set or an idler gear pair that transmits the driving force from the motor 16 to the pressure gear 11.

For example, as illustrated in FIG. 3B, when the motor 16 rotates counterclockwise, the second idler gear 15 and the pressure gear 11 rotate clockwise while the first idler gear 14 rotates counterclockwise. Accordingly, the pressure roller 3 rotates clockwise.

When a driving force F1 is applied to the pressure gear 11 as the motor 16 rotates, a pulling force F2 is generated to pull the pressure roller 3 toward the fixing nip N.

The pulling force F2 is very weak at the non-drive part R0 of the pressure roller 3 on one hand, the drive part R1 of the pressure roller 3 provided with the pressure gear 11 receives the pulling force F2 that is enough to pull the pressure roller 3 toward the fixing nip N on the other hand.

In FIG. 3B, the forces applied to the rotary shafts are indicated by solid line arrows F2, F4, and F6; whereas the forces applied to the gears are indicated by broken line arrows F1, F3, and F5.

Figure 4A:
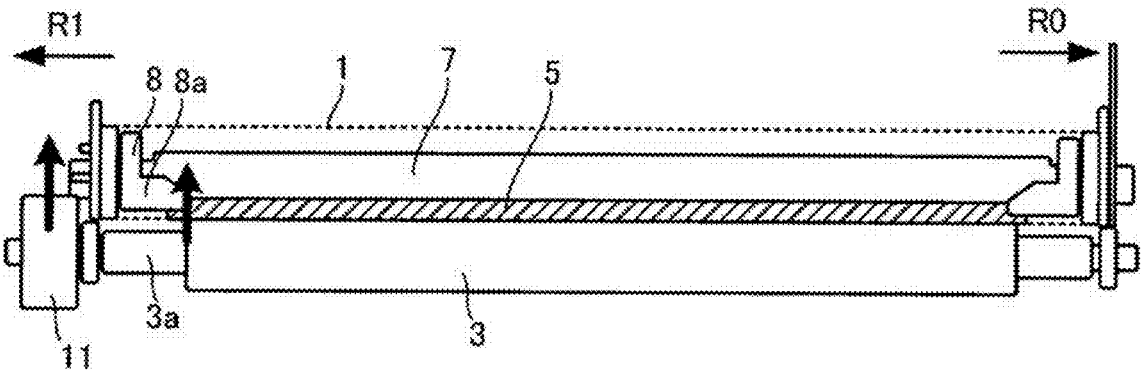
FIG. 4A is a top view of a fixing device according to an embodiment of the present disclosure.
Figure 4B:
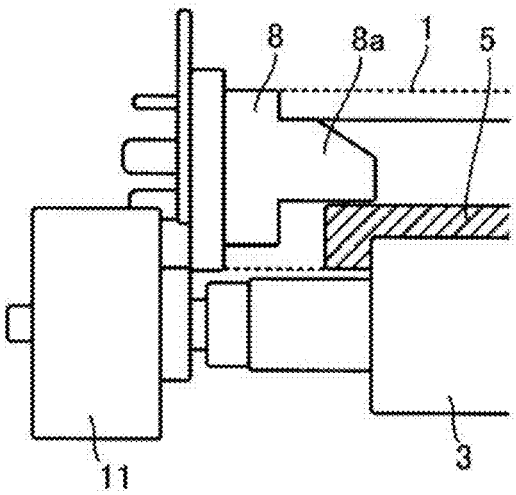
FIG. 4B is a partially enlarged view of the fixing device of FIG. 4A.

Referring now to FIGS. 4A and 4B, a description is given of how the load is unevenly applied to the fixing belt 1.

FIG. 4A is a top view of the fixing device 10 in a longitudinal direction of the fixing device 10. FIG. 4B is an enlarged view of the drive part R1 of the fixing device 10 of FIG. 4A.

When the pressure roller 3 receives a pulling force from the pressure gear 11, the load is applied to the core 3*a*. Then, the drive part R1 of the pressure roller 3 is pulled toward the fixing nip N. Thereafter, the non-drive part R0 of the pressure roller 3 is pulled toward the fixing nip N. This causes unevenness in the width of the fixing nip N and the load applied to the fixing nip N. As a result, the sliding load (i.e., torque) may increase or the linear velocity may vary, leading to failure in conveyance of the sheet P.

In particular, at the drive part R1, the load on the fixing belt 1 may locally increase due to the unevenness in load, bringing the fixing belt 1 into point contact with an edge of the thermal equalizer 5 or a projecting bent portion of the thermal equalizer 5. In other words, the fixing belt 1 locally and strongly slides over such an edge or projecting bent portion of the thermal equalizer 5. In this way, the fixing belt 1 repeatedly slides over such an edge or projecting bent portion of the thermal equalizer 5 and may be damaged finally.

The thermal equalizer 5 of the present embodiment is shaped to address such a situation. Specifically, according to the present embodiment, the thermal equalizer 5 is shaped such that a longitudinal end portion of the thermal equalizer 5 does not come into point contact with the inner circumferential surface of the fixing belt 1. Such a shape of the thermal equalizer 5 reduces the load on the inner circumferential surface of the fixing belt 1 and prevents damage to the fixing belt 1. The thermal equalizer 5 has inclined portions that are inclined to narrow the thermal equalizer 5 toward a longitudinal end of that the thermal equalizer 5. Such inclined portions separate the thermal equalizer 5 from the inner circumferential surface of the fixing belt 1 toward the longitudinal end of the thermal equalizer 5. Now, a description is given of a start position of inclination and an angle of inclination.

Figure 5A:
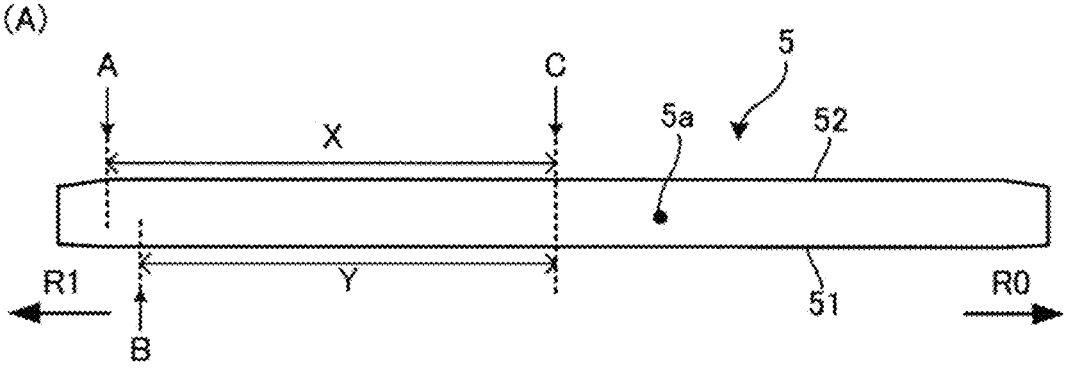
FIG. 5A is a plan view of a thermal equalizer of a fixing device according to an embodiment of the present disclosure.
Figure 5B:
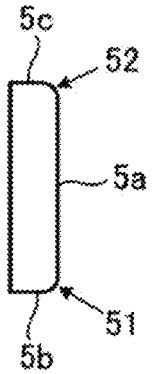
FIG. 5B is an end view of the thermal equalizer of FIG. 5A.

Initially with reference to FIGS. 5A and 5B, a description is now given of the start position of inclination.

FIG. 5A is a plan view of the first face 5*a* of the thermal equalizer 5 facing the pressure roller 3.

In FIG. 5A, a distance X indicates a distance between a longitudinal center C of the thermal equalizer 5 and an inclination start position A as a start position of inclination. A distance Y indicates a distance between the longitudinal center C of the thermal equalizer 5 and a position B to which the longitudinal end of the pressure roller 3 contacts via the fixing belt 1.

FIG. 5B is an end view of the thermal equalizer 5. As illustrated in FIG. 5B, in a plan view of the nip formation surface of the thermal equalizer 5, the upstream boundary portion 51 corresponds to the upstream end of the first face 5*a* in the direction of rotation of the fixing belt 1; whereas the downstream boundary portion 52 corresponds to the downstream end of the first face 5*a* in the direction of rotation of the fixing belt 1. In short, the upstream boundary portion 51 is a boundary between the first face 5*a* and the second face 5*b*; whereas the downstream boundary portion 52 is a boundary between the first face 5*a* and the third face 5*c*.

If a relation of X<Y is satisfied, in other words, if the inclination start position A is closer to the longitudinal center C of the thermal equalizer 5 than the position B to which the longitudinal end of the pressure roller 3 contacts via the fixing belt 1, an increased tension to the fixing belt 1 may decrease the durability of the fixing belt 1. If a hump at the inclination start position A comes into contact with the inner circumferential surface of the fixing belt 1, the thermal equalizer 5 comes into point contact with the inner circumferential surface of the fixing belt 1, leading to damage to the fixing belt 1.

If a relation of X>Y is satisfied, the pressure roller 3 is shortened. In other words, a shortened fixing nip N is formed between the fixing belt 1 and the pressure roller 3. As a result, the image quality may be degraded.

To address such a situation, the distance X between the longitudinal center C of the thermal equalizer 5 and the inclination start position A is preferably equal to the distance Y between the longitudinal center C of the thermal equalizer 5 and the position B to which a longitudinal end of the pressure roller 3 contacts via the fixing belt 1. In short, a relation of X=Y is satisfied.

Figure 6A:
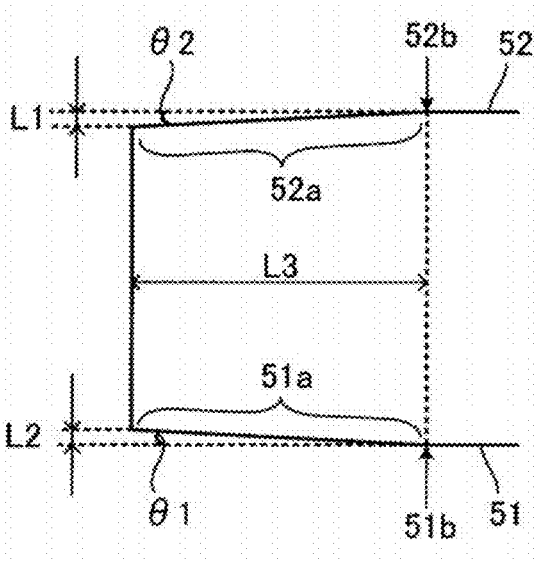
FIG. 6A is an enlarged view of a portion, proximate to a driving assembly, of a thermal equalizer according to an embodiment of the present disclosure.
Figure 6B:
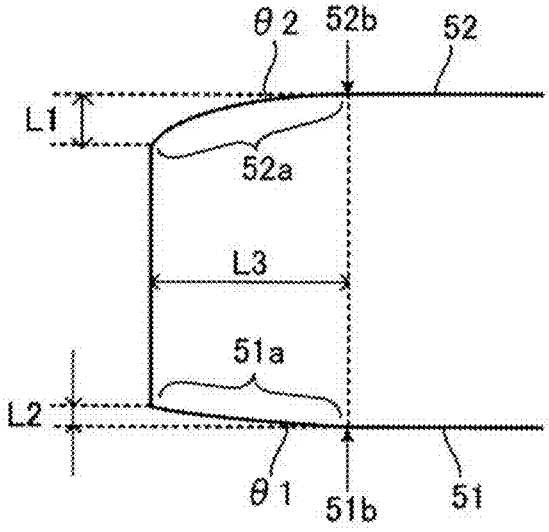
FIG. 6B is an enlarged view of a portion, proximate to a driving assembly, of another example of the thermal equalizer of FIG. 6A.

Referring now to FIGS. 6A and 6B, a description is given of an angle of inclination.

FIG. 6A is an enlarged view of a portion, proximate to the driving assembly, of thermal equalizer 5. FIG. 6B is an enlarged view of a portion, proximate to the driving assembly, of another example of the thermal equalizer 5 of FIG. 6A. In short, FIG. 6A is a partially enlarged view of the drive part R1 of the thermal equalizer 5. FIG. 6B is a partially enlarged view of the drive part R1 of another example of the thermal equalizer 5.

As illustrated in FIGS. 6A and 6B, the upstream boundary portion 51 as the upstream end of the first face 5*a* and the downstream boundary portion 52 as the downstream end of the first face 5*a* include inclined portions 51*a* and 52*a*, respectively. The inclined portions 51*a* and 52*a* are inclined to narrow the first face 5*a* toward a longitudinal end of the thermal equalizer 5.

The cases described below clarify a preferable angle of inclination at the inclined portions 51*a* and 52*a* to prevent damage to the fixing belt 1 driven a given number of times. In the following description, angles of inclination θ1 and θ2 at inclination start positions 51*b* and 52*b*, respectively, may be referred to simply as an angle of inclination θ.

In a case in which θ=0°, in other words, when no inclination is provided, a longitudinal end portion of the thermal equalizer 5 damages the fixing belt 1.

In a case in which 0°<θ≤3°, in other words, when the angle of inclination is not greater than 3°, the fixing belt 1 is not damaged.

In a case in which 3°<θ, in other words, when the angle of inclination exceeds 3°, the fixing belt 1 is damaged at the position B at which the fixing belt 1 contacts the longitudinal end of the pressure roller 3.

The cases described above clarify that the inclined portions 51*a* and 52*a* preferably have an angle of inclination not greater than 3°.

Figure 7:
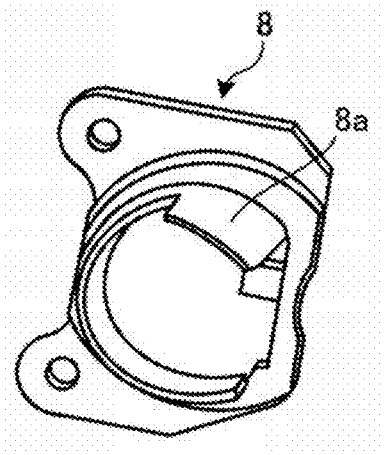
FIG. 7 is a diagram illustrating a belt holder according to an embodiment of the present disclosure.

As illustrated in FIGS. 1, 4A, and 4B, the belt holder 8 holds the fixing belt 1. As illustrated in FIG. 7, the belt holder 8 includes a wing 8*a*.

The fixing belt 1 that rotates while being held by the belt holder 8 tries to return to the original cylindrical shape downstream from an area of contact between the fixing belt 1 and the pressure roller 3 in the direction of rotation of the fixing belt 1. If the thermal equalizer 5 has no inclined portion, the fixing belt 1 may receive tension from an area of contact between the fixing belt 1 and the thermal equalizer 5 and from an area of contact between the fixing belt 1 and the wing 8*a* of the belt holder 8, resulting in an increase in load on the fixing belt 1.

To address such a situation, the thermal equalizer 5 includes the inclined portions 51*a* and 52*a* that separates the fixing belt 1 from the thermal equalizer 5, thus providing an area in which the fixing belt 1 does not contact the thermal equalizer 5 and reducing the load on the fixing belt 1.

FIGS. 6A and 6B illustrate a downstream distance L1 between the fixing belt 1 and the thermal equalizer 5 in the direction of rotation of the fixing belt 1.

In order to reduce the load on the fixing belt 1 while maintaining the downstream distance L1, the shape of the thermal equalizer 5 may be changed in a thickness direction of the thermal equalizer 5. However, such a change in thickness of the thermal equalizer 5 may affect the nip formation. To prevent such an undesirable situation, in a case in which the thermal equalizer 5 is provided with an inclined portion that reduces the thickness of the thermal equalizer 5, it is preferable that the angle of inclination be not greater than 1° at the inclination start positions outside an area of contact between the thermal equalizer 5 and the pressure roller 3 via the fixing belt 1, and that the cross section be a quadratic curve toward the longitudinal end of the thermal equalizer 5.

FIGS. 6A and 6B illustrate an upstream distance L2 between the fixing belt 1 and the thermal equalizer 5 in the direction of rotation of the fixing belt 1. Since the fixing belt 1 is not affected by the load caused by the wing 8*a* upstream in the direction of rotation of the fixing belt 1, the upstream distance L2 may be smaller than the downstream distance L1.

The thermal equalizer 5 having a configuration as described above reduces the influence of the unevenness in load generated at the start of rotation and prevents damage or breakage of the inner circumferential surface of the fixing belt 1.

As described above with reference to FIGS. 1 and 2, according to an embodiment of the present disclosure, the fixing device 10 includes the fixing belt 1 serving as a fixing rotator, the pressure roller 3 serving as a pressure rotator, the belt holder 8, the pressure gear 11, the thermal equalizer 5, the nip formation pad 6, and the support 7. Specifically, the fixing belt 1 is a rotatable endless belt. The pressure roller 3 is rotatable and presses an outer circumferential surface of the fixing belt 1. The belt holder 8 holds the fixing belt 1. The pressure gear 11 is disposed proximate to a longitudinal end of the pressure roller 3 to rotate the pressure roller 3. In other words, the pressure gear 11 is disposed at a longitudinal end part of the pressure roller 3. The thermal equalizer 5 is disposed facing an inner circumferential surface of the fixing belt 1 along a longitudinal direction (i.e., axial direction) of the pressure roller 3. The nip formation pad 6 presses the inner circumferential surface of the fixing belt 1 via the thermal equalizer 5 to form the fixing nip N between the fixing belt 1 and the pressure roller 3. The support 7 supports the thermal equalizer 5 and the nip formation pad 6. The thermal equalizer 5 includes the first face 5*a*, the second face 5*b*, and the third face 5*c*. The first face 5*a* faces the fixing nip N. The second face 5*b* bends and extends from the upstream end of the first face 5*a* in the direction of rotation of the fixing belt 1. The third face 5*c* bends and extends from the downstream end of the first face 5*a* in the direction of rotation of the fixing belt 1.

As described above with reference to FIGS. 5A to 6B, the upstream boundary portion 51 as a boundary between the first face 5*a* and the second face 5*b* and the downstream boundary portion 52 as a boundary between the first face 5*a* and the third face 5*c* include the inclined portions 51*a* and 52*a*, respectively, at least in a longitudinal end portion of the thermal equalizer 5 proximate to the pressure gear 11 (i.e., at the drive part R1). The inclined portions 51*a* and 52*a* are inclined to narrow the first face 5*a* toward a longitudinal end of the thermal equalizer 5. The inclined portion 51*a* of the upstream boundary portion 51 has an angle of inclination (i.e., θ1) not greater than 3°. Similarly, the inclined portion 52*a* of the downstream boundary portion 52 has an angle of inclination (i.e., θ2) not greater than 3°.

The upstream boundary portion 51 and the downstream boundary portion 52 of the thermal equalizer 5 are smoothly continuous curved surfaces without edges. As illustrated in FIGS. 5A to 6B, in a longitudinal plan view of the first face 5*a*, the upstream boundary portion 51 corresponds to the upstream end of the first face 5*a* in the direction of rotation of the fixing belt 1; whereas the downstream boundary portion 52 corresponds to the downstream end of the first face 5*a* in the direction of rotation of the fixing belt 1.

As described above, the upstream boundary portion 51 as a boundary between the first face 5*a* and the second face 5*b* of the thermal equalizer 5 and the downstream boundary portion 52 as a boundary between the first face 5*a* and the third face 5*c* of the thermal equalizer 5 include the inclined portions 51*a* and 52*a*, respectively, preferably in each longitudinal end portion of the thermal equalizer 5 (i.e., at each of the drive part R1 and the non-drive part R0). The inclined portions 51*a* and 52*a* are inclined to narrow the first face 5*a* toward a longitudinal end of the thermal equalizer 5. At least in the longitudinal end portion of the thermal equalizer 5 proximate to the pressure gear 11 (i.e., at the drive part R1), the inclined portion 51*a* of the upstream boundary portion 51 has an angle of inclination (i.e., θ1) not greater than 3° while the inclined portion 52*a* of the downstream boundary portion 52 has an angle of inclination (i.e., θ2) not greater than 3°.

In the fixing device 10 of the present embodiment, the configuration of the thermal equalizer 5 at the drive part R1 alone reduces the local load caused by the pulling force, without processing each of the opposed longitudinal end parts (i.e., the drive part R1 and the non-drive part R0) of the thermal equalizer 5 into a complicated shape. Thus, the thermal equalizer 5 reduces processing and manufacturing costs of the fixing device 10.

The inclined portions 51*a* and 52*a* of the thermal equalizer 5 are preferably located outside an area in which the thermal equalizer 5 faces the pressure roller 3 in the longitudinal direction of the thermal equalizer 5.

Preferably, at least an edge or an inflection point of a projecting bent portion of the thermal equalizer 5 does not come into point contact with the inner circumferential surface of the fixing belt 1. More preferably, inclined portions of the thermal equalizer 5 does not contact the inner circumferential surface of the fixing belt 1.

Accordingly, the load on the fixing belt 1 at the start of rotation is reduced. Such reduced load on the fixing belt 1 prevents damage to the inner circumferential surface of the fixing belt 1 while the fixing belt 1 slides over the thermal equalizer 5.

In the thermal equalizer 5, each of the inclined portion 51*a* of the upstream boundary portion 51 and the inclined portion 52*a* of the downstream boundary portion 52 may have a linear shape as illustrated in FIG. 6A or a quadratic curved shape as illustrated in FIG. 6B.

The quadratic curved shape is preferable to the linear shape to reduce the angle of inclination at the inclination start point and secure the distance between the thermal equalizer 5 and the fixing belt 1.

As described above with reference to FIG. 7, the fixing belt 1 receives tension from the area of contact between the fixing belt 1 and the thermal equalizer 5 and from the area of contact between the fixing belt 1 and the wing 8*a* of the belt holder 8 downstream in the direction of rotation of the fixing belt 1. In short, the load on the fixing belt 1 increases downstream in the direction of rotation of the fixing belt 1.

To address such a situation, in the thermal equalizer 5, the inclined portion 52*a* of the downstream boundary portion 52 is inclined greater than the inclined portion 51*a* of the upstream boundary portion 51 as illustrated in FIGS. 6A and 6B.

Such a configuration reduces the tension applied to the fixing belt 1 downstream in the direction of rotation of the fixing belt 1 and therefore reduces the unevenness in load and prevents the life of the fixing belt 1 from being shortened.

A relation of L1>L2 is preferably satisfied, where L1 represents a distance, in a short direction of the thermal equalizer 5, between the inclination start position 52*b* of the downstream boundary portion 52 and a longitudinal end of the thermal equalizer 5 and L2 represents a distance, in the short direction of the thermal equalizer 5, between the inclination start position 51*b* of the upstream boundary portion 51 and the longitudinal end of the thermal equalizer 5.

Satisfaction of the relation of L1>L2 prevents the interference between the longitudinal end portion of the thermal equalizer 5 and the inner circumferential surface of the fixing belt 1.

More preferably, each of the distances L1 and L2 is not smaller than 0.5 mm in the short direction of the thermal equalizer 5.

The distances L1 and L2 that are not smaller than 0.5 mm reliably prevent the interference between the longitudinal end portion of the thermal equalizer 5 and the inner circumferential surface of the fixing belt 1.

For example, even in a case in which a length indicated by L3 in FIGS. 6A and 6B is relatively short, the distances L1 and L2 that are not smaller than 0.5 mm are preferably secured with the inclined shape of a quadratic curve and at the angles of inclination (i.e., θ1 and θ2) not greater than 3°. Note that the length indicated by L3 in FIGS. 6A and 6B is a distance between the longitudinal end of the pressure roller 3 and the longitudinal end of the thermal equalizer 5.

The thermal equalizer 5 is preferably made of a material having an increased thermal conductivity and easy to process. For example, the thermal equalizer 5 is preferably made of one of aluminum and copper.

The fixing device 10 including the thermal equalizer 5 described above is mountable on a high copies per minute (CPM) machine (i.e., a machine having a relatively high fixing temperature) to enhance the productivity.

Figure 8:
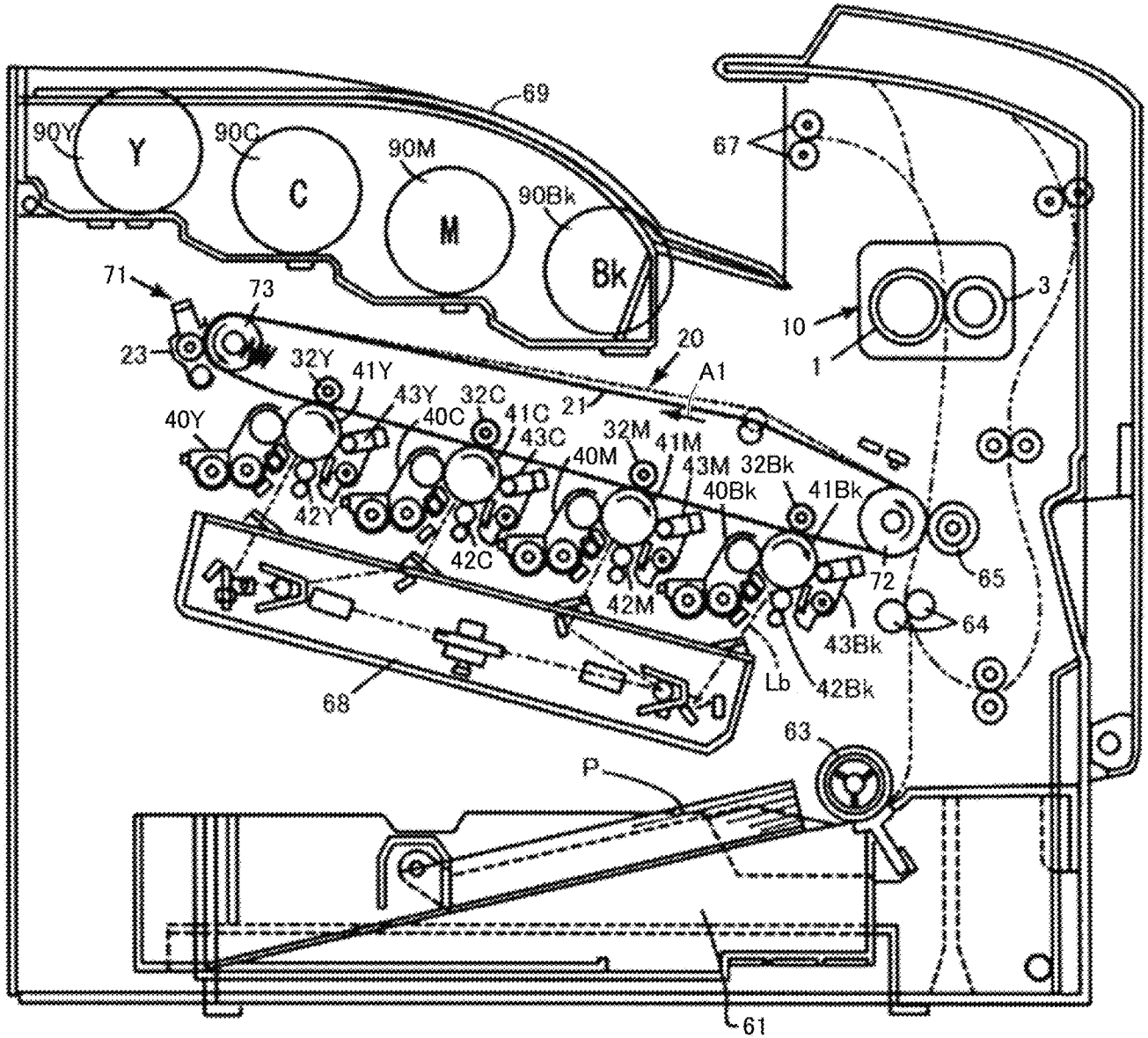
FIG. 8 is a schematic diagram illustrating an image forming apparatus according to an embodiment of the present disclosure.

Referring now to FIG. 8, a description is given of an electrophotographic image forming apparatus 100 that includes the fixing device 10 described above.

FIG. 8 is a schematic diagram illustrating the image forming apparatus 100 according to an embodiment of the present disclosure.

Specifically, FIG. 8 illustrates the image forming apparatus 100 as a color printer employing a tandem system in which a plurality of image forming devices is aligned in a direction in which a transfer belt is stretched, to form toner images in different colors. The image forming apparatus 100 is not limited to such a color printer that employs the tandem system. Alternatively, according to an embodiment of the present disclosure, the image forming apparatus 100 may be, e.g., a copier, a facsimile machine, or a multifunction peripheral (MFP) having at least two of printing, copying, scanning, facsimile, and plotter functions.

As illustrated in FIG. 8, the image forming apparatus 100 employs a tandem system or structure in which four drum-shaped photoconductors 41Y, 41C, 41M, and 41Bk are disposed side by side. The photoconductors 41Y, 41C, 41M, and 41Bk, serving as image bearers, form toner images of yellow, cyan, magenta, and black as separation colors, respectively.

In the image forming apparatus 100 illustrated in FIG. 8, the toner images, as visible images, of yellow, cyan, magenta, and black formed on the photoconductors 41Y, 41C, 41M, and 41Bk, respectively, are primarily transferred onto a transfer belt 21 serving as an intermediate transferor. The transfer belt 21 is an endless belt disposed facing the photoconductors 41Y, 41C, 41M, and 41Bk and rotatable in a direction indicated by arrow A1, which may be referred to as a rotation direction Al in the following description. Specifically, in a primary transfer process, the yellow, cyan, magenta, and black toner images are superimposed one atop another on the transfer belt 21, thus being transferred from the photoconductors 41Y, 41C, 41M, and 41Bk, respectively, onto the transfer belt 21 that rotates in the rotation direction A1. Thereafter, in a secondary transfer process, the yellow, cyan, magenta, and black toner images are transferred together from the transfer belt 21 onto a sheet P serving as a recording medium. Thus, a composite color toner image is formed on the sheet P.

The photoconductors 41Y, 41C, 41M, and 41Bk are respectively surrounded by various pieces of equipment to form the yellow, cyan, magenta, and black toner images as the photoconductors 41Y, 41C, 41M, and 41Bk rotate. For example, the photoconductor 41Bk is surrounded by a charger 42Bk, a developing device 40Bk, a primary transfer roller 32Bk, and a cleaner 43Bk in this order in a direction in which the photoconductor 41Bk rotates. With such pieces of equipment, the black toner image is formed. Like the photoconductor 41Bk, the photoconductors 41Y, 41C, and 41M are respectively surrounded by chargers 42Y, 42C, and 42M, developing devices 40Y, 40C, and 40M, primary transfer rollers 32Y, 32C, and 32M, and cleaners 43Y, 43C, and 43M in this order in a direction in which the photoconductors 41Y, 41C, and 41M rotate. After the charger 42Bk charges the photoconductor 41Bk, for example, an optical writing device 68 writes an electrostatic latent image on the photoconductor 41Bk.

As the transfer belt 21 rotates in the rotation direction A1, the yellow, cyan, magenta, and black toner images respectively formed as visible images on the photoconductors 41Y, 41C, 41M, and 41Bk are primarily transferred successively onto the transfer belt 21 such that the yellow, cyan, magenta, and black toner images are superimposed one atop another on the transfer belt 21. Specifically, the primary transfer rollers 32Y, 32C, 32M, and 32Bk disposed facing the photoconductors 41Y, 41C, 41M, and 41Bk via the transfer belt 21, respectively, are supplied with electric voltage to transfer the yellow, cyan, magenta, and black toner images at different times onto the transfer belt 21 from the photoconductors 41Y, 41C, 41M, and 41Bk in this order. Note that the photoconductor 41Y is an upstream photoconductor and the photoconductor 41Bk is a downstream photoconductor in the rotation direction A1 of the transfer belt 21.

In other words, the photoconductors 41Y, 41C, 41M, and 41Bk are aligned in this order in the rotation direction A1 of the transfer belt 21. The photoconductors 41Y, 41C, 41M, and 41Bk are located in four image forming stations that form the yellow, cyan, magenta, and black toner images, respectively.

In other words, the image forming apparatus 100 includes the four image forming stations that form the yellow, cyan, magenta, and black toner images, respectively. In addition, the image forming apparatus 100 includes a transfer belt unit 20, a secondary transfer roller 65, a transfer belt cleaner 23, and the optical writing device 68. The transfer belt unit 20 is situated above and facing the photoconductors 41Y, 41C, 41M, and 41Bk. The transfer belt unit 20 includes the transfer belt 21 and the primary transfer rollers 32Y, 32C, 32M, and 32Bk. The secondary transfer roller 65, serving as a transferor, is disposed facing the transfer belt 21 and rotated in accordance with rotation of the transfer belt 21. The transfer belt cleaner 23 is disposed facing the transfer belt 21 to clean the surface of the transfer belt 21. The optical writing device 68 is disposed below and facing the four image forming stations.

The optical writing device 68 includes, e.g., a semiconductor laser serving as a light source, a coupling lens, an fθ lens, a toroidal lens, a deflection mirror, and a rotatable polygon mirror serving as a deflector. The optical writing device 68 emits a laser beam Lb, corresponding to image data of each color of yellow, cyan, magenta, and black, to each of the photoconductors 41Y, 41C, 41M, and 41Bk. For example, as illustrated in FIG. 8, the optical writing device 68 emits the laser beam Lb to the photoconductor 41Bk. Thus, the optical writing device 68 writes or forms an electrostatic latent image on each of the photoconductors 41Y, 41C, 41M, and 41Bk.

The image forming apparatus 100 further includes a sheet feeding device 61 and a registration roller pair 64. The sheet feeding device 61 includes a sheet tray that loads a plurality of sheets P, which is conveyed one by one to an area of contact, herein called a secondary transfer nip, between the transfer belt 21 and the secondary transfer roller 65. Activation of the registration roller pair 64 is timed to feed a sheet P conveyed from the sheet feeding device 61 to the secondary transfer nip between the transfer belt 21 and the secondary transfer roller 65 such that the sheet P meets the yellow, cyan, magenta, and black toner images on the transfer belt 21 at the secondary transfer nip. The image forming apparatus 100 further includes a sensor to detect that a leading end of the sheet P reaches the registration roller pair 64.

The image forming apparatus 100 further includes the fixing device 10 described above, a sheet ejection roller pair 67, an output tray 69, and toner bottles 90Y, 90C, 90M, and 90Bk. The fixing device 10 fixes, onto the sheet P bearing a composite color toner image constructed of the yellow, cyan, magenta, and black toner images, the composite toner image.

The sheet ejection roller pair 67 ejects the sheet P bearing the fixed toner image outside a housing of the image forming apparatus 100. The output tray 69 is disposed atop the housing of the image forming apparatus 100, as an upper portion of the image forming apparatus 100. The sheet P is ejected onto the output tray 69 outside the housing of the image forming apparatus 100 by the sheet ejection roller pair 67. The toner bottles 90Y, 90C, 90M, and 90Bk are situated below the output tray 69. The toner bottles 90Y, 90C, 90M, and 90Bk are replenished with fresh toner of yellow, cyan, magenta, and black, respectively.

In addition to the transfer belt 21 and the primary transfer rollers 32Y, 32C, 32M, and 32Bk, the transfer belt unit 20 includes a driving roller 72 and a driven roller 73. The transfer belt 21 is entrained around the driving roller 72 and the driven roller 73.

A biasing member, such as a spring, biases the driven roller 73 against the transfer belt 21. With such a configuration, the driven roller 73 serves as a tension applicator that applies tension to the transfer belt 21. The transfer belt unit 20, the secondary transfer roller 65, and the transfer belt cleaner 23 together construct a transfer device 71.

The sheet feeding device 61 is disposed in a lower portion of the housing of the image forming apparatus 100. The sheet feeding device 61 includes a sheet feeding roller 63 that contacts an upper face of an uppermost sheet P of the plurality of sheets P loaded on the sheet tray of the sheet feeding device 61. As the sheet feeding roller 63 is rotated counterclockwise in FIG. 8, the sheet feeding roller 63 feeds the uppermost sheet P toward the registration roller pair 64.

The transfer belt cleaner 23 of the transfer device 71 includes a cleaning brush and a cleaning blade disposed so as to face and contact the transfer belt 21. With the cleaning brush and the cleaning blade, the transfer belt cleaner 23 scrapes extraneous matter such as residual toner off the transfer belt 21, thereby removing the extraneous matter from the transfer belt 21. Thus, the transfer belt cleaner 23 cleans the transfer belt 21.

The transfer belt cleaner 23 further includes a waste toner conveyer that conveys and discards the residual toner removed from the transfer belt 21.

According to the embodiments of the present disclosure, there is provided a fixing device that reduces the influence of the unevenness in load generated at the start of rotation and prevents the occurrence of damage or breakage of an inner circumferential surface of an endless belt serving as a fixing rotator.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A fixing device comprising:

a fixing rotator;

a pressure rotator configured to press an outer circumferential surface of the fixing rotator;

a belt holder configured to hold the fixing rotator;

a pressure gear disposed proximate to a longitudinal end of the pressure rotator to rotate the pressure rotator;

a thermal equalizer disposed facing an inner circumferential surface of the fixing rotator along a longitudinal direction of the pressure rotator;

a nip formation pad configured to press the inner circumferential surface of the fixing rotator via the thermal equalizer to form a fixing nip between the fixing rotator and the pressure rotator; and a support configured to support the thermal equalizer and the nip formation pad, the thermal equalizer including:

a first face facing the fixing nip;

a second face bending and extending from an upstream end of the first face in a direction of rotation of the fixing rotator; and a third face bending and extending from a downstream end of the first face in the direction of rotation of the fixing rotator, each of an upstream boundary portion as a boundary between the first face and the second face and a downstream boundary portion as a boundary between the first face and the third face including, at least in a longitudinal end portion of the thermal equalizer proximate to the pressure gear, an inclined portion inclined to narrow the first face toward a longitudinal end of the thermal equalizer and having an angle of inclination not greater than 3°.

2. The fixing device according to claim 1, wherein each of the upstream boundary portion and the downstream boundary portion of the thermal equalizer includes, in another longitudinal end portion of the thermal equalizer, the inclined portion inclined to narrow the first face toward another longitudinal end of the thermal equalizer, and wherein the inclined portion of each of the upstream boundary portion and the downstream boundary portion has an angle of inclination not greater than 3° at least in the longitudinal end portion of the thermal equalizer proximate to the pressure gear.

3. The fixing device according to claim 1, wherein the inclined portion of the thermal equalizer is located outside, in a longitudinal direction of the thermal equalizer, an area in which the thermal equalizer faces the pressure rotator.

4. The fixing device according to claim 1, wherein the inclined portion of each of the upstream boundary portion and the downstream boundary portion of the thermal equalizer has one of a linear shape and a quadratic curved shape.

5. The fixing device according to claim 1, wherein the inclined portion of the downstream boundary portion of the thermal equalizer is inclined greater than the inclined portion of the upstream boundary portion of the thermal equalizer.

6. The fixing device according to claim 1, wherein a relation of $L1>L2$ is satisfied, where L1 represents a distance, in a short direction of the thermal equalizer, between an inclination start position of the downstream boundary portion and the longitudinal end of the thermal equalizer and L2 represents a distance, in the short direction of the thermal equalizer, between an inclination start position of the upstream boundary portion and the longitudinal end of the thermal equalizer.

7. The fixing device according to claim 1, wherein each of L1 and L2 is not smaller than 0.5 mm, where L1 represents a distance, in a short direction of the thermal equalizer, between an inclination start position of the downstream boundary portion and the longitudinal end of the thermal equalizer and L2 represents a distance, in the short direction of the thermal equalizer, between an inclination start position of the upstream boundary portion and the longitudinal end of the thermal equalizer.

8. The fixing device according to claim 1, wherein the thermal equalizer is made of one of aluminum and copper.

9. The fixing device according to claim 1, wherein the fixing rotator is an endless belt.

10. An image forming apparatus comprising:

an image bearer configured to bear a toner image; and the fixing device according to claim 1, configured to fix the toner image onto a recording medium.

* * * * *